United States Patent [19]

Tamai et al.

[11] 3,963,486

[45] June 15, 1976

[54] ELECTROPHOTOGRAPHIC IMAGING PROCESS EMPLOYING EPOXY-ESTER CONTAINING LIQUID DEVELOPER

[75] Inventors: Yasuo Tamai; Hajime Miyatuka; Satoru Honjo, all of Tokyo, Japan

[73] Assignee: Rank Xerox Ltd., London, England

[22] Filed: Mar. 26, 1975

[21] Appl. No.: 562,298

Related U.S. Application Data

[62] Division of Ser. No. 362,598, May 21, 1973, Pat. No. 3,907,693.

[52] U.S. Cl. ..... 96/1 LY; 427/16; 427/17

[51] Int. Cl.[2] ..... G03G 13/10

[58] Field of Search ..... 96/1 LY; 427/16, 17; 252/62.1 L

[56] References Cited

UNITED STATES PATENTS

| | | | |
|---|---|---|---|
| 3,268,332 | 8/1966 | Caruso et al. | 252/62.1 L |
| 3,337,340 | 8/1967 | Matkan et al. | 252/62.1 L |
| 3,444,083 | 5/1969 | Oliphant | 252/62.1 L |
| 3,519,566 | 7/1970 | Garrett et al. | 252/62.1 L |
| 3,522,181 | 7/1970 | Garrett et al. | 252/62.1 L |

*Primary Examiner*—David Klein
*Assistant Examiner*—John R. Miller
*Attorney, Agent, or Firm*—J. J. Ralabate; D. C. Kolasch

[57] ABSTRACT

A liquid electrophotographic developer and processes for employing same are disclosed. The developer is composed of a liquid carrier, pigment, and a resin which results in a developed image that is abrasion resistant. The developer contains from 5 to 70% of the resin component which comprises an epoxy-ester.

4 Claims, No Drawings

ELECTROPHOTOGRAPHIC IMAGING PROCESS EMPLOYING EPOXY-ESTER CONTAINING LIQUID DEVELOPER

This is a division of application Ser. No. 362,598, filed May 21, 1973, now U.S. Pat. No. 3,907,693.

BACKGROUND OF THE INVENTION

This invention relates to electrostatography and more specifically to electrostatographic developers employed therein.

The well-known art of xerography normally employs charging a photoconductive element, selectively exposing it and then developing the element with either a dry or liquid developing system. The image may then be used in situ transferred or otherwise employed. The liquid electrophotographic developers generally employed constitute a dispersion system in which submicron sizes of toner powder composed of resin and pigment are stably dispersed in a highly insulating liquid medium functioning as a liquid carrier. The electrical resistance of the highly insulating liquid carrier must be at least $10^{11}$ ohm-centimeters generally speaking. Thus, materials such as cyclohexane, methylcyclohexane, p-cymene, decalin (decahydronaphthalene), kerosene, isoparaffinic hydrocarbons, chloro-fluorinated hydrocarbons and various grades of industrial gasolines are normally employed for this purpose. Conventionally employed pigments are inorganic pigments such as carbon black, chrome yellow, lead chromate and other lead pigments; cadmium sulphide and other cadmium pigments; ultramarine, Prussian blue, cobalt oxide and other cobalt pigments; organic pigments such as phthalocyanine pigments and azo pigments. The resins which are normally employed are alkyd resins, resin-modified formaldehyde resins, polyamide resins, polyvinyl chloride-acetate copolymer resins and many others.

Among these ingredients employed in a liquid electrophotographic developer the resin is perhaps the most important in that its effect is predominant in the characteristics of the developing solution. The electric charge of the toner is also largely dependent on the resin. Thus, alkyd resins are particularly useful in that they result in positively charged toner. The alkyd resin also is useful as a vehicle for the pigment, for example, the most difficult pigments to disperse such as carbon black and phthalocyanine can be relatively smoothly dispersed by blending them with alkyd resin. This procedure provides an excellent liquid developer containing positively charged toner. Thus, a great many species of the alkyd resins are employed for this purpose such as resin-modified alkyds, phenol-modified alkyd, styrene-modified alkyds and others.

It is the resin component which also greatly affects the strength of the toner layer covering the surface of the photoconductive layer. In a liquid phase developing process the excess amount of developing solution adhered to the photoconductive layer must be removed after development by squeezing it with a roller in order to avoid formation of fog on the white background. In some cases a mere squeezing does not give satisfactory results and the surface must be further washed with rinse solution. Prior to such washing it is necessary to pass the photoconductive member including the toner through a pressure roller system in order to prevent transferring of the toner image into the rinse solution. Furthermore, it is necessary after washing to pass the washed and developed photoconductive members through a pressure roller system in order to make it as dry as possible. Such treatment of the photoconductive member with a pressure roller system requires considerable strength of the toner layer so that the layer is not peeled off or abraded upon direct contact with the roller. Nevertheless, the usual types of liquid developers are generally deficient in such strength. Many of the alkyd resins above described are not suitable from the viewpoint of mechanical strength even though they possess excellent characteristics for charging and dispersion.

Furthermore, the liquid phase developing process is characterized by its property to reproduce continuous tone images. This characteristic is effectively utilized in a particular process in which the photoconductive members are held between plural pairs of rollers which drive the photoconductive member through a developer. In this process the metallic roller system effectively function as a short distance anti-electrode since the roller is in contact with the surface thereof. Thus, an image of excellent quality with negligible edge effect is obtained which also possesses excellent continuous tone reproduction. It is understood that this optimal process requires even greater strength of the toner layers compared with other processes since the photoconductive surface having the toner layer on its surfaces is repeatedly brought into contact with metallic rollers.

The resins which constitute a part of the commercially employed liquid developers are relatively readily soluble in liquid carriers which is generally the cause of poor strength of the toner layers. In fact, liquid developers are rare which can be employed for the above mentioned roller contact process. There is, therefore, a demonstrated continuing need for the provision of liquid developers which are abrasion resistant.

It is therefore an object of the instant invention to provide an electrophotographic developer which is devoid of the above noted deficiencies.

It is a further object of this invention to provide liquid developers which are abrasion resistant.

Yet again another object of this invention is to provide a liquid developer which provides enough strength in the toner layer to prevent peeling or removal of toner layer by action of the metallic rollers.

Again another object of this invention is to provide a novel liquid developer.

A further object of this invention is to provide a liquid developer which performs satisfactorily in connection with contact electrodes or pressure rollers either of which is brought into direct contact with a photoconductive layer in or immediately after development.

Still another object of this invention is to provide a liquid developer derived from a stable dispersion of fine toner particles in a liquid carrier which will result in images having excellent continuous tone reproduction.

These and other objects of the instant invention are accomplished generally speaking by providing a liquid electrophotographic developer comprising a liquid carrier, a pigment, and a resin which produces a high mechanical strength of toner image, the strength of the toner image being most noticeable during and after the development step normally employed in electrophotographic process. The electrophotographic developer employed comprises from about 5 to 70% of a resin component which comprises an epoxy-ester.

The electrophotographic developer so described resists abrasion in the toner layer after development so that no peeling is noticed when the toner layer is contacted by pressure rollers during or after the development process. It is noted that the strength of the toner layer may be further increased without impairing other electrophotographic characteristics which are necessary for successful development. Therefore, it should be understood that known types of developers which are deficient in these abrasion resistant properties may be improved by incorporating an epoxy-ester into the deficient electrophotographic developer according to the system of the instant invention.

Generally speaking, the electrical resistivity of the epoxy-ester in a solution state is ten fold greater than that of an alkyd resin in the same state. Therefore there is no deleterious effect in incorporating epoxy-esters because of their solubility so that a decrease of resistivity results and thereby the practicality of employing same for their cited advantages is rendered impractical. The electrophotographic developer as described finds particular utility in developing systems which are equipped with contact electrodes of the metallic roller type so as to realize one of the most significant advantages of liquid phase developing process that is excellent continuous tone reproducibility. The developers of the instant invention are most notably superior in this respect and in these applications since they demonstrate a far superior strength in the toner images in resisting abrasion and thereby preventing removal of the toner layer from the surface of the photoconductive layer when it is brought into contact with metallic rollers during and after the development step.

Any suitable inorganic or organic photoconductive material may be employed in the system of the instant invention. Typical organic materials include: triphenylamine; 2,4-bis(4,4'-diethyl-aminophenyl)-1,3,4-oxadiazol; N-isopropylcarbazole triphenylpyrrol; 4,5-diphenyl-imidazolidinone; 4,5-diphenylimidazolidinethione; 4,5-bis-(4'-aminophenyl)-imidazolidinone; 1,5-dicyanonaphthalenel 1,4-dicyanonaphthalene; aminophthalodinitrile; nitrophthalodinitrile; 1,2,5,6-tetraaza-N-isoproplycarbazole triphenylpyrrol; 4,5-diphenylimidazolidinone; 4,5-diphenylimidazolidinethione; 4-5-bis-(4'-aminophenyl)-imidazolidione; 1,5-dicyanonaphthalene; 1,4-dicyanonaphthalene; aminophthalodinitrile; nitrophthalodinitrile; 1,2,5,6-tetraazacyclooctatetraene-(2,4,6,8); 2-mercapto-benzthiazole; 2-phenyl-4-diphenylidene-oxazolone; 6-hydroxy-2,3,-di(p-methoxyphenyl)-benzofurane; 4-dimethylamino benzylidene-benzylidene-benzhydrazide; 3-benzylidene-aminocarbazole; polyvinyl carbazole; (2-nitrobenzylidene)-p-bromoaniline; 2,3-diphenyl quinazoline; 1,2,4-triazine; 1,5-diphenyl-3-methyl-pyrazoline; 2-(4'-dimethylaminophenyl)-benzoxazole; 3-aminocarbazole; phthalocyanines; trinitrofluoronone-polyvinylcarbazole; charge transfer complexes and mixtures thereof. Typical inorganic materials include: sulfur, selenium, zinc sulfide, zinc oxide, zinc cadmium sulfide, zinc magnesium oxide, cadmium selenide, zinc silicate, calcium-strontium sulfide, cadmium sulfide, indium trisulfide, gallium triselenide, arsenic disulfide, arsenic trisulfide, arsenic triselenide, antimony trisulfide, cadmium sulfoselenide and mixtures thereof.

Any suitable method of charging may be employed in the system of the instant invention. Typical methods of charging include: corona, charge deposition resulting from air breakdown in the gap commonly referred to as TESI or charging in vacuo with an electron gun.

Any suitable method of exposure may be employed in the system of the instant invention. Typical methods of exposure include: reflex, contact, holographic techniques, non-lens slit scanning systems, and optical projection systems involving lens imaging of opaque-reflection subjects as well as transparent film originals.

Any suitable method of fixing may be employed in the system of the instant invention. Typical methods include application of heat, solvent removal and incorporation of fixing resins.

Any suitable amount of epoxy-ester may be employed as a resin component of the electrophotographic developer of the instant invention. Employing an insufficient amount of epoxy-ester results in poor strength of the toner layer so that it is found that a lower limit of 5% of resin by weight or preferably 10% or greater should be employed. The epoxy-ester may be mixed with resin and pigment prior to the blending process or the epoxy-ester may be subjected to a blending together with resin, pigment, diluent and additives until a uniform dispersion is obtained. In addition the epoxy-ester may be merely dissolved into a liquid developer. An increase in the amount of epoxy-ester results in increased strength of the toner layer. However, when the resin content exceeds a certain value of strength of the toner layer begins to decrease noticeably and as a result peeling is observed when the photoconductive surface bearing the toner image is brought into contact with pressure rollers. It is believed that this phenomenon is caused by the increased strength of the toner layer resulting from its tackiness due to the presence of the epoxy-ester, so that a rather high content of epoxy-ester exceeding a certain value causes adhesion of the epoxy-ester to the roller surface and thereby results in the peeling of the toner by the roller. It has therefore been found that the epoxy-ester content should not exceed the value of 70% by weight. This upper limit also avoids coagulation of the toner which results when the resin comprises the major portion of the resin component so that the stability of the dispersion of the pigment is lost. It is therefore found that the epoxy resin should be employed in the amount of from 5 to 70% by weight and more preferably from about 10 to 50% by weight of the total resin. It is found that when both the total resin content in the developer and the epoxy-ester content in the total resin are high sufficient strength of the toner layer is observed when the total resin content in the developer is found to be from about 0.1 to 5% by weight. In addition the content of the epoxy-ester is not particularly restricted by its ratio to the pigment employed. Thus the content of epoxy-ester resin may range from 0.5 parts to 50 parts by weight per one part of pigment. It is found that when the epoxy-ester is employed as the sole component of the resin component a developer results which possesses positively polarized toner. However, epoxy-esters alone do not generally serve as suitable vehicles for pigments since when used alone with a pigment they do not result in a sufficiently stabilized dispersion. It is necessary therefore, for the epoxy resin to be combined with other resins such as alkyd and others so that the properties of the epoxy resin may be realized.

Any suitable resin may be combined with the epoxy resin of the instant invention. Typical resins include alkyd, resin-modified alkyd, phenol-modified alkyd, styrene-modified alkyd, resin-modified formaldehyde, and polyamide resins.

Any suitable pigment may be employed in the system of the instant invention. Typical pigments include channel black, furnace black, phthalocyanine blue, Prussian blue, quinacridone magenta, thioindigo magenta, benzidine yellow, and others.

The high mechanical strength of the toner layer realized in the liquid developer of the instant invention indicates the formation of strong mutual bonding between the toner particles themselves in the toner image residing on the photoconductive layer as well as between the toner particles and the photoconductive layer. Naturally the latter bonding depends on the composition of the photoconductive layer to a considerable extent. Nevertheless, the characteristics of the epoxy-ester containing developer depend on the specie of bonding resin and the ratio of photoconductor to resin in the photoconductive layer only to a small extent. As a result it is permissible to select the specie of bonding resin in the photoconductive layer merely with regard to the electrical charge retention desired in various insulating liquids. For example, when the liquid carrier is composed of an isoparaffinic hydrocarbon with low solubility the bonding resin in the photoconductive layer may be selected from many thermoplastic resins such as polyacrylic esters, polymethylacrylic esters, copolymers of acrylic esters with styrene, vinyl acetate or methacrylic esters, and vinyl chloride-acetate copolymers. When the carrier liquid employed is cyclohexane, kerosene, decalin or aliphatic hydrocarbons mixed with small amounts of aromatic hydrocarbon all of which have great solubility, cross-linked polymers containing considerable proportions of non-polar monomer units such as styrene and butyl methacrylate in the form of copolymers are more desirable than the thermoplastic resins since the thermoplastics are not preferred by reason of their poor charge retention in this case. Such cross-linked polymers may be selected from alkyd, epoxy-ester, epoxy and polyurethane resins. Preferred of these are alkyd resins and epoxy-ester resins in which polyisocyanate is employed as a cross-linking agent. The ratio of photoconductive powder to bonding resin normally employed is 1:1 to 20:1 and preferably 3:1 to 10:1.

Any suitable epoxy-ester may be employed in the system of the instant invention. Typical epoxy-esters are those which contain an acid component composed of vegetable fatty acid, styrene-modified vegetable fatty acid, tall oil, resin, hydrogenated rosin or dimerized rosin. Preferred of these are those resins which are soluble in non-polar solvents. The desired solubility is normally attained when the content of vegetable fatty acid exceeds 49%. It is found that a combination of resin with vegetable fatty acid results in a high solubility in nonpolar solvents. For example, an epoxy-ester composed of linseed fatty acid 40%, resin 18% and epoxy resin 42% is soluble in mineral spirits so that it is useful according to the precepts of the instant invention. However, an extremely high content of resin or hydrogenated or dimerized resin reduces the strength of toner image and often defeats the advantages of the instant developer.

Any suitable vegetable fatty acid may be employed in the system of the instant invention. Typical vegetable fatty acids include dehydrated castor oil, linseed oil, and soy bean oil among others. The above were found to polymerize with the passing of time so that often the addition of an anti-oxidant is employed in the developer such as 2,6-di-tert-butyl-p-cresol; 0-tert-butyl-p-cresol; 2,3,5,6-tetramethylphenol; at a concentration ranging from about 0.01 to 2% by weight of the total carrier.

To further define the specifics of the present invention, the following examples are intended to illustrate and not limit the particulars of the present system. Parts and percentages are by weight unless otherwise indicated.

EXAMPLE I

The following ingredients are mixed in a blender and milled in a ball-mill for about 50 hours until a homogeneous dispersion is obtained:

| | |
|---|---|
| Carbon black | 20 parts by weight |
| Varnish obtained by heating a mixtu.e of rosin-modified formaldehyde resin and linseed oil | 500 parts by weight |
| Decaline | 400 parts by weight |

A first developer is prepared by diluting a part by weight of the above dispersion with 30 parts by weight of a 1:3 volume ratio mixture of decaline and kerosene. Developers II through VII are prepared by dissolving various amounts of epoxy-ester resin (Beckosol P 789, trade name of linseed fatty ester manufactured by Japan Reichhold, oil length 57%) into the developer base I, the first produced developer. The controlled developers III through VII relate to the present invention. Their developing characteristics as compared with those developers containing little or no epoxy-ester are seen in the following table.

| Developer | Epoxy-ester Content in the Resin | Squeeze-Resistance In Developing Part | Squeeze-Resistance In Rinsing Part |
|---|---|---|---|
| I | 0 % | x | x |
| II | 2.5 % | Δ | x |
| III | 5 % | o | o |
| IV | 10 % | o | o |
| V | 30 % | o | o |
| VI | 60 % | o | o |
| VII | 80 % | x | x |

x—Peeling is observed in toner layer.
Δ—Slight peeling is observed in toner layer.
o—No peeling is observed in toner layer.

The development above performed has been carried out with a developing apparatus equipped with four pairs of metallic roller contact electrodes wherein the photoconductive member to be treated is passed through squeeze rollers in order to be freed of developer, washed with an Isopar E, isoparaffinic solvent rinse liquor and then passed through the squeeze roller arrangement until excess rinse liquor is squeezed out. As is seen by the table an epoxy-ester content ranging from 5 to 60% of total resin yields satisfactory results. Developer I which contains no epoxy-ester exhibits marked peeling over the surface of the toner layer. Although these results were obtained employing four pairs of metallic roller contact electrodes, it is found that substantially no different results are obtained with less than this number of electrodes, for example, even with one pair, the toner layer is found to be only slightly less abraded.

EXAMPLE II

The same mixture as employed in Example I is further mixed with epoxy-ester in the amounts described in Example I. The mixtures obtained are separately blended until respective homogeneous dispersions are obtained, as in Example I. A part of this dispersion is diluted with 30 parts of liquid carrier to yield a developer as obtained in Example I. These developers are tested as to abrasion resistance with similar results obtained as in Example I.

EXAMPLE III

Developers are prepared as outlined in Example I with the exception that the varnish obtained by heating a mixture of rosin-modified formaldehyde resin and linseed oil (400 parts) and epoxy-ester resin (Peckosol P 789, 100 parts) are employed as the resin ingredients. When tested as in Example I no peeling is observed in the toner layer and the squeeze resistance is found to be satisfactory.

EXAMPLE IV

The following mixture is prepared in a ball-mill for about 100 hours: phthalocyanine blue 30 parts by weight, linseed oil-modified alkyd resin (oil length 60%) 300 parts, epoxy-ester resin (Epicosol 807 MS, soya bean fatty ester, oil length 54%, Japan Coating Co.) 100 parts, kerosene 300 parts. The dispersion obtained is diluted with 30-fold weight of kerosene to yield a liquid developer. This developer exhibits an excellent squeeze-resistance so that no peeling is observed in the toner layer when employed in a developing apparatus.

EXAMPLE V

The following ingredients are mixed in a ball-mill for about 100 hours:

| | |
|---|---|
| Quinacridone magenta | 20 parts by weight |
| Safflower-oil-modified alkyd resin (oil length 75% | 300 parts by weight |
| Epoxy-ester (Epicosol 810 MS, Japan Coating Co.) | 60 parts by weight |

-continued

| | |
|---|---|
| Decalin | 300 parts by weight |

This dispersion is diluted with about 30 fold weight of 1:1 mixture by volume of decalin and kerosene to yield an electrophotographic developer. This developer exhibits an excellent squeeze resistance when employed as in Example 1 in a developing mode.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize or otherwise desirably affect the properties of the systems for their present use.

Anyone skilled in the art will have other modifications occur to him based on the teachings of the present invention. These modifications are intended to be encompassed within the scope of this invention.

What is claimed is:

1. An electrophotographic imaging process comprising charging a photoconductive member, selectively exposing said member to imagewise radiation to which it is sensitive, and developing said member with a liquid developer, said developer consisting essentially of an insulating liquid carrier, a pigment, and a resin mixture, said resin comprising epoxy-ester in a range of from 5 to 70% by weight of the resin and the remainder of the resin mixture is selected from the group consisting of alkyd, resin-modified alkyd, phenol-modified alkyd, styrene-modified alkyd, rosin-modified formaldehyde and polyamide resins.

2. The process as defined in claim 1 wherein during said developing step roller electrodes are pressed into contact with said photoconductive surface.

3. The process as defined in claim 1 further comprising removing the excess amount of said liquid developer after said development step by pressing rollers into contact with said photoconductive surface.

4. The process as defined in claim 1 wherein said epoxy-ester contains an acid component selected from the group consisting of vegetable fatty acid, styrene-modified vegetable fatty acid, tall oil, rosin, hydrogenated rosin and dimerized rosin.

* * * * *